United States Patent [19]

Jones

[11] Patent Number: 4,564,546

[45] Date of Patent: Jan. 14, 1986

[54] EASILY RELEASABLE MAT HOLDER

[75] Inventor: W. Gregory Jones, Woodstock, Ga.

[73] Assignee: Kimberly-Clark Corporation, Neenah, Wis.

[21] Appl. No.: 685,436

[22] Filed: Dec. 24, 1984

[51] Int. Cl.[4] ..... B32B 3/02; A47L 23/22

[52] U.S. Cl. ..... 428/81; 428/124; 428/125; 428/126; 428/131; 428/192; 15/215

[58] Field of Search ..... 428/81, 124, 125, 126, 428/131, 192; 15/215, 216

[56] References Cited

U.S. PATENT DOCUMENTS 3,435,480 4/1969 Mann ..... 15/215

*Primary Examiner*—Alexander S. Thomas

*Attorney, Agent, or Firm*—William D. Herrick

[57] ABSTRACT

Improved holder specially adapted for disposable floor mats to be placed adjacent entryways to factories, industrial buildings, or the like or for use in connection with clean rooms, hospitals, laboratories. The holder includes a flat base adapted to hold the mat and at least one hingedly connected side flap adapted to fold over on top of an edge of the mat and securely retain it in position. Means are included to hold the flap against the mat in a closed position to firmly resist movement that would cause wrinkles or bunches in the mat which could cause trips or falls. In accordance with the invention, the base support includes at least one hand hole adjacent the edge of the base and located so as to be covered by the flap in the closed position. By means of the hand hole, direct pressure may be applied directly against the flap or by pressing against the mat so as to overcome the holding means and greatly facilitate opening of the flap to release the mat when desired. Preferred embodiments include materials of construction that are rigid and sufficiently heavy and have a nonskid surface so as to resist movement of the structure and the embodiment wherein two hand holes are included in each side having a hinged flap so as to allow pressure to be exerted at spaced locations and further facilitate opening of the flap.

6 Claims, 4 Drawing Figures

EASILY RELEASABLE MAT HOLDER

BACKGROUND OF THE INVENTION

1. Field of the Invention

The present invention is directed to holders for flexible flat materials. In particular, the present invention is directed to such holders useful for containing disposable floor mats for use, for example, in entryways to plants and factories, retail stores, and for industrial applications such as clean rooms, hospitals, laboratories, and the like. Holders for such mats ideally will maintain them in position and avoid folding or wrinkling which could produce a danger of tripping resulting in a fall. On the other hand, since maintenance of such mats normally will be performed as a routine janitorial function, such holders must be easily opened to replace the mats in a quick and efficient manner. While the present invention will be described with reference to such a holder for floor mats, it will be recognized by those skilled in this art that other uses may be made for the holder of the invention such as for wall hangings, embroidery and the like.

2. Description of the Prior Art

Conventional floor mats comprise a rubber or rigid plastic base, normally rectangular, with slightly raised edges to form a recess adapted to contain the mat. In use the mat is simply positioned in the recess, and the combination placed in the location desired. The edges of the holder are normally beveled so as to reduce the likelihood of tripping. Reference may be had, for example, to U.S. Pat. No. 3,083,393 to Nappi which illustrates such a structure further including screw means adapted to maintain a pad of paper-like doormats in position. Another example of such a holder is illustrated in U.S. Pat. No. 4,143,194 to Wihksne dated Mar. 6, 1979. A difficulty with such conventional holders is that, during use, a mat, particularly when wet, may tend to wrinkle, bunch, or fold decreasing its effectiveness and presenting a hazard. To overcome this, various clamp means have been devised to close over the mat and maintain it taut and in position. For example, U.S. Pat. No. 3,435,480 to Mann, Jr. dated Apr. 1, 1969 illustrates such a combination. While effective for the desired purpose, it has been found that, in order to provide sufficient clamping force and in the structure designed to present smooth edges reducing the danger of tripping, opening the holder when desired to replace the mat has presented a problem. This is normally a hand operation performed as a routine janitorial chore. The smooth transition between the holder and the mat leaves little room to grasp the edge of the holder clamped against the mat, particularly when sufficient pressure has been applied to aggressively hold the mat in position. The present invention is directed to improved holders for mats and the like greatly facilitating the ability to quickly and efficiently open the holder and replace the mat.

SUMMARY OF THE INVENTION

The present invention is directed to an improved holder for floor mats or the like which comprises a generally rectangular frame of relatively rigid material such as rubber, vinyl, or other relatively hard plastic material. The base is adapted to support a mat or other flat structure and includes adjacent at least one of the sides a hingedly secured flap adapted to be folded over the edge of the enclosed flat structure. The flap in this position is held in the closed position to maintain the edge of the flat structure in position. In accordance with the invention the base includes at least one aperture in the location covered by the flap and positioned so as to permit direct hand pressure to be applied through the aperture against the flap or against the flap by pushing the flat structure thus facilitating opening of the flap. In preferred embodiments the flaps are positioned with associated hand holes adjacent each of the four edges of the holder so that all sides of the flat structure are maintained in position when the flaps are closed. In a further preferred embodiment the means holding the flap in a closed position include a lip adjacent the inside edge of the holder which covers and presses against a corresponding lip on the edge of the flap to urge it downward in the closed position. An additional alternative embodiment includes a separate support means centrally located in the holder and of a size so as to provide cushioning and maintain the flat structure substantially even with the top of the folded flap thereby minimizing any danger of tripping. The combination thus presents a holder that maintains the mat firmly in position and yet is quickly and easily opened through the hand holes to release and replace the mat.

DESCRIPTION OF THE PREFERRED EMBODIMENTS

Figure 1:
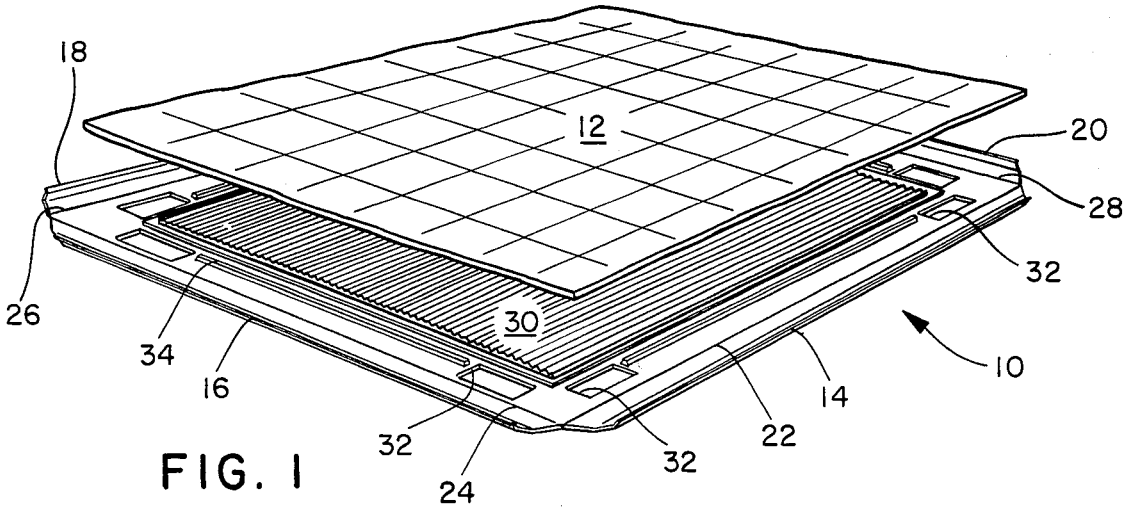
FIG. 1 is a perspective view of one embodiment to the holder of the present invention showing it in the open position and ready to receive a floor mat or other flat flexible structure.

While the invention will be described in connection with a preferred embodiment as a holder for a floor mat, it will recognized that it is also applicable as a holder for other flat flexible structures such as wall hangings or the like. However, it will be of most benefit where such holders are required to be frequently opened to replace the flat structure such as in the case of disposable floor mats.

The holder in accordance with the present invention may be made of materials conventionally used for such holders. For example, for a floor mat holder, it may be of a relatively rigid plastic material such as polypropylene or vinyl of sufficient thickness to provide desired durability. It is important that the material be sufficiently heavy to resist easy displacement and that it be durable enough to resist deterioration over the intended period of use. To provide further resistance to displacement, the bottom surface of the holder preferably has a nonslip treatment which may be accomplished by forming a texture into the bottom surface or by applying a nonskid coating or laminate in a pattern or overall treatment. The flap member will normally be of the same material as the base of the holder and, preferably, will form an integral hinge so that the flaps are formed at the same time as the base and yet capable of being folded over many times to cover the edge or edges of the enclosed material. Such hinges are known, and their construction will be apparent to those skilled in the art. The flaps may be constructed of different material if desired and hingely mounted to the base support.

The flaps formed by folding over onto the edges of the enclosed material will be of sufficient width so as to firmly grasp the enclosed material. Also, in the case of floor mat holders, the flap will ideally be beveled so that the risk of tripping is reduced. For most purposes an overlap of about ½ up to six inches, preferably ¾ to two inches, will be adequate, and the width of the flap will be about ¼ to one inch larger, for example, in order to accommodate the hinge and possible mat dimensions/-tolerance variations. Also, as will be recognized by those skilled in the art, the corners of the flaps are cut so as to permit the overlap fold to take place without interference between the flaps.

Various means may be employed to urge the flaps towards the closed position maintaining the enclosed mat or other flat structure firmly in position. For this purpose, the force exerted on a floor mat, for example, will be such as to clamp the mat between the flap edge and the base. Since the mat may be of relatively thin construction, particularly for disposable applications, it will be apparent that some difficulty may be encountered in attempting to open the mat holder flaps. In accordance with the present invention, this problem is overcome by means of one or more hand holes disposed through the bottom of the support structure and located underneath the flap so that pressure may be exerted directly through the hand holes and against the folded flap. While one such hand hole will obviously be of benefit, particularly for larger floor mat applications, it is preferred that two hand holes per side where a hinge is located be included. The size and location of these hand holes may vary but will be sufficient to permit pressure to be exerted therethrough and preferably located near the ends of the sides so as to most effectively exert pressure on the flap.

Figure 3:
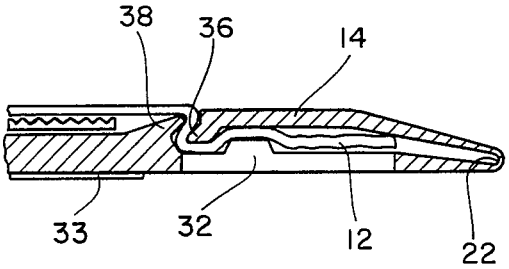
FIG. 3 is a cross-sectional view of a hand access opening of the mat and holder combination of FIGS. 1 and 2 showing the flap in the closed position.

The holder of the invention will now be described with reference to the drawings in which like numerals refer to like elements in the several figures. Turning to FIG. 1, mat holder 10 is shown in the open configuration and ready to receive mat 12. Along the sides are flaps 14, 16, 18 and 20 open by means of hinges 22, 24, 26 and 28. Also in this case support 30, which may comprise a variety of cushioning materials such as foam or ribbed vinyl, for example, is included to position mat 12 in a closed position generally level with the folded over flap as illustrated in FIG. 3 and to provide cushioning. In this embodiment, apertures 32 are included two to each side and adjacent the ends of respective sides of the bottom support 34.

Figure 2:
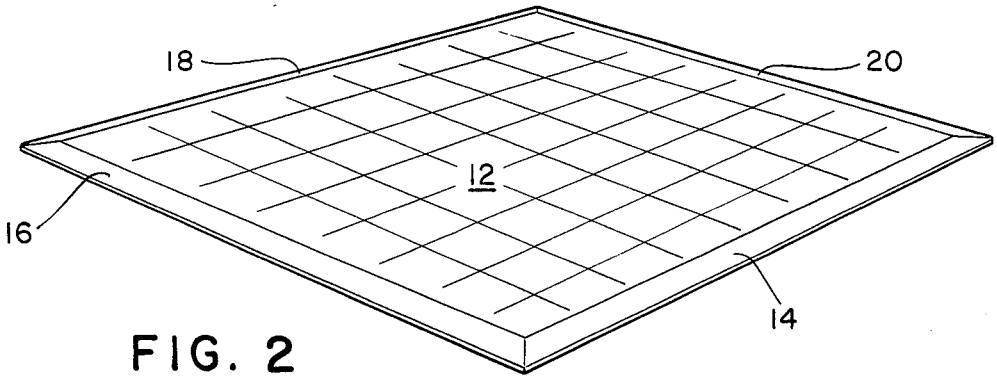
FIG. 2 is an illustration of the holder and mat combination of FIG. 1 in the closed position showing the mat held firmly on all four sides.

Once the mat 12 is in position, flaps 14, etc., are folded over so that lip member 36 is forced under a corresponding lip 38 in the base 34. This provides means to urge the flap 14 etc. in the closed position due to the resilience of lips 36 and 38 and, when clamped against the mat 12 as shown in FIG. 2, maintains mat 12 securely in position. FIG. 3 illustrates the fully closed holder enclosing mat 12 including slip resistant strip 33 on the bottom of holder 10.

Figure 4:
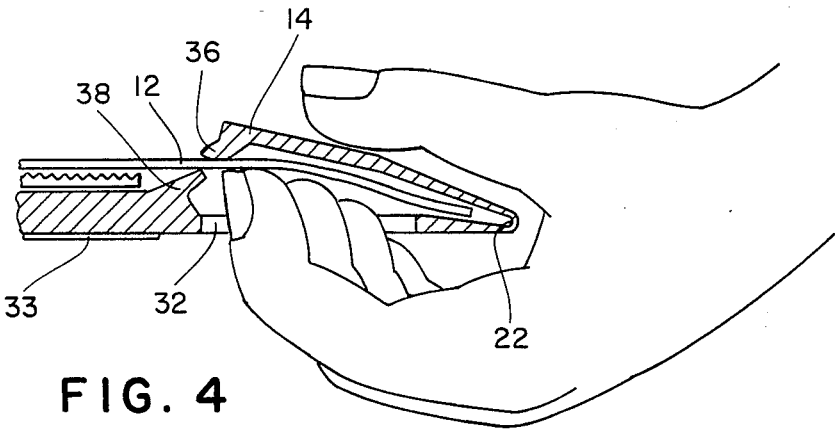
FIG. 4 is an illustration similar to that of FIG. 3 showing the flap being opened to release the mat.

Turning to FIG. 4, it can be seen that direct pressure may be exerted against flap 14 by means of hand hole 32 and pushing against the mat 12. Thus lip 36 may be forced over lip 38 releasing the flap and allowing it to be folded outward by means of hinge 22. This may be accomplished at one aperture 32 or at both apertures on a given side using both hands if desired. In this manner opening of the holder 10 so as to easily remove the mat may be greatly facilitated. Thus, use of the holder in accordance with the present invention will improve efficiency and, since it will permit allowing increased pressure to be exerted on the mat, will reduce incidences of the mat being prematurely or inadvertently released forming wrinkles or bunches that may cause trips or falls.

Thus, it is apparent that there has been provided, in accordance with the invention, an improved mat holder construction that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

I claim:

1. Holder for a floor mat or the like comprising, (a) a self-supporting frame having a base and four sides generally forming a rectangle and adapted to support a mat or other flat, flexible structure, (b) flap means adjacent at least one side of said rectangle and hingedly connected to said sides so as to open to admit said flat structure and close over the corresponding edge of said structure to maintain it in position, (c) means associated with said flap and said base to hold said flap in the closed position; and (d) at least one aperture in said base position so as to be covered by said flap and of a size adapted to permit hand pressure to be applied through said aperture against said flap or against said flat structure sufficient to overcome said holding means and open said flap.

2. The holder of claim 1 having flap means, holding means and apertures adjacent each side edge of said rectangular frame.

3. The holder of claims 1 or 2 wherein said flap or flaps are formed integrally with said frame.

4. The holder of claim 3 formed of polypropylene.

5. The holder of claims 1 or 2 wherein said holding means comprises lips formed in the edge of said flap or flaps and in corresponding edge or edges of said base and adapted to urge the flap in a closed position.

6. The holder of claim 3 having two hand holes in each of said flap or flaps.

* * * * *